US005360944A

United States Patent [19]

Springer et al.

[11] Patent Number: 5,360,944

[45] Date of Patent: Nov. 1, 1994

[54] HIGH IMPEDANCE, STRIPPABLE ELECTRICAL CABLE

[75] Inventors: Denis D. Springer, Austin, Tex.; Randall L. Alberg, Woodbury; Mark W. Breault, Oakdale, both of Minn.

[73] Assignee: Minnesota Mining and Manufacturing Company, St. Paul, Minn.

[21] Appl. No.: 986,769

[22] Filed: Dec. 8, 1992

[51] Int. Cl.[5] ..... H01B 7/08

[52] U.S. Cl. ..... 174/117 F; 174/36; 174/102 R; 174/117 FF; 174/120 R

[58] Field of Search ..... 174/117 F, 117 FF, 36, 174/102 R, 120 R

[56] References Cited

U.S. PATENT DOCUMENTS

| | | | |
|---|---|---|---|
| Re. 31,477 | 12/1983 | Marshall | 174/115 |
| 1,533,936 | 4/1925 | Martin-Harvey . | |
| 3,258,522 | 6/1966 | Bartos et al. . | |
| 3,433,891 | 3/1969 | Zysk et al. . | |
| 3,612,743 | 10/1971 | Angele et al. | 174/36 |
| 3,757,029 | 9/1973 | Marshall | 174/36 |
| 3,867,564 | 2/1975 | Kardashian | 174/36 |
| 4,113,335 | 9/1978 | Lang et al. | 174/72 A X |
| 4,155,613 | 5/1979 | Brandeau . | |
| 4,185,162 | 1/1980 | Bogese, II | 174/32 |
| 4,218,581 | 8/1980 | Susuki | 174/117 |
| 4,226,823 | 10/1980 | Jansson et al. | 174/120 SR X |
| 4,308,421 | 12/1981 | Bogese, II | 174/32 |
| 4,375,379 | 3/1983 | Luetzow | 174/72 A X |
| 4,443,657 | 4/1984 | Hill et al. | 174/110 |
| 4,456,785 | 6/1984 | Kushner et al. | 174/120 R X |
| 4,468,089 | 8/1984 | Brorein . | |
| 4,475,006 | 10/1984 | Olyphant, Jr. | 174/36 |
| 4,492,815 | 1/1985 | Maros | 174/78 |
| 4,533,784 | 8/1985 | Olyphant, Jr. | 174/36 |
| 4,642,480 | 2/1987 | Hughes et al. | 307/147 |
| 4,767,894 | 8/1988 | Schombourg | 174/106 |
| 4,924,037 | 5/1990 | Ainsworth et al. | 174/117 F |
| 4,988,835 | 1/1991 | Shah | 174/117 F |
| 5,001,303 | 3/1991 | Coleman et al. | 174/102 R |
| 5,030,794 | 7/1991 | Schell et al. | 174/36 |
| 5,151,561 | 9/1992 | Emery et al. | 174/120 R |

FOREIGN PATENT DOCUMENTS

| | | | |
|---|---|---|---|
| 2754342 | 6/1979 | Germany | 174/117 F |

OTHER PUBLICATIONS

*Electronic Products,* Oct. '89, p. 55, Product Highlights.

*Ribbon-Ax Update,* No. 2, Feb. '90, Unlimited Design Possibilities.

*Primary Examiner*—Morris H. Nimmo

*Attorney, Agent, or Firm*—Gary L. Griswold; Walter N. Kirn; David W. Anderson

[57] ABSTRACT

A high impedance cable includes a first layer of insulation surrounding a series of conductors to form a conventional ribbon cable and a second layer of insulation which conforms to the first layer of insulation and is retained in contact with the first layer of insulation in a manner which substantially excludes air from between the two layers of insulation but permits the second layer of insulation to be stripped from the ribbon cable for convention mass termination of the ribbon cable.

9 Claims, 1 Drawing Sheet

HIGH IMPEDANCE, STRIPPABLE ELECTRICAL CABLE

FIELD OF THE INVENTION

The present invention relates generally to electrical cables, particularly to ribbon cables having a number of parallel conductors in a single plane and most particularly to shielded ribbon cables having greatly increased insulation for increased impedance.

BACKGROUND OF THE INVENTION

So-called "ribbon" cables are presently popular and in general use for conducting a plurality of electrical signals. Ribbon cables usually comprise a large number of cylindrical stranded or solid conductors extending in parallel and spaced equidistant from each other in a single plane. These conductors are covered by a polymeric insulation in the shape of cylinders surrounding each conductor, with each cylinder of insulation being joined to the adjacent cylinder between adjacent conductors to produce profiled major surfaces on each side of the cable defined by arcuate ridges aligned with each conductor and grooves bisecting the distance between conductors.

These cables are commonly used in conjunction with connectors having U-shaped contacts designed to cut through the insulation layer and contact the underlying conductor. The profiled shape of the major surfaces of the cable allows the cable to be conveniently and accurately aligned with the connector contacts prior to "mass termination" of the connection between the cable and the connector which is accomplished by forcing the cable into the U-shaped contacts with a press and thus completing all conductor connections at once.

A drawback of these mass-terminable ribbon cables, particularly when used in a shielded format, is that the insulation layer must necessarily be fairly thin to allow for profiling of the insulation and driving of the contact through the insulation. Thin insulation results in a cable which is not suitable for high impedance, very high quality transmission of signals. It is well known to increase the impedance of the cable, and thus its ability to transmit signals without introducing distortion, by increasing the thickness of the insulation surrounding the conductors. Attempts have been made to retain the advantageous benefits of conventional shielded ribbon cable while increasing impedance by covering both major surfaces of the ribbon cable with layers of insulation, as shown in FIGS. 1 and 2. These layers can be either loose (FIG. 1) and retained by a metal shield wrapped around the layers or bonded to the ribbon cable (FIG. 2) by such means as an adhesive.

Although these methods increase impedance, the first method allows the distance of the shields to the conductors to vary which results in impedance variation, increased crosstalk and variation in signal propagation velocity. In method two, the addition of adhesive is unsatisfactory because the adhesive is typically of a higher dielectric constant and loss tangent than the primary insulation, causing increased signal loss and lower propagation velocities. In addition, the adhesive does not remove cleanly with the dielectric spacer when the cable is prepared for termination. Permanent attachment of the added insulation to the ribbon cable also makes mass termination of the ribbon cable difficult as a result of the total cable thickness being too large for insulation displacement connectors.

SUMMARY OF THE INVENTION

The present invention provides a high impedance, strippable cable capable of mass termination comprising in one aspect a ribbon cable including a series of spaced, parallel conductors lying in a single plane, which conductors are covered and held together by a first layer of insulation, and a second layer of insulation overlying and in contact with the first layer of insulation, wherein the second layer of insulation may be separated from the first layer of insulation without damaging the first layer of insulation. The second layer of insulation may be extruded over the first layer of insulation or may be formed as two or more separate pieces which are either bonded to the first layer or retained in contact with the first layer by a metal shield surrounding the second layer of insulation. In any construction, the cable preferably includes a metal shield adhesively bonded to the second layer of insulation.

In another aspect the invention may be one or more conductors covered by a first and a second layer of insulation as above, wherein the two layers of insulation are of identical material. This construction is also preferably covered by a metal shield adhesively bonded to the second layer of insulation.

BRIEF DESCRIPTION OF THE DRAWINGS

The present invention will be more particularly described with respect to the accompanying drawing, wherein like numbers refer to like numbers in the several views, and wherein.

DESCRIPTION OF THE PREFERRED EMBODIMENTS

Figure 1:
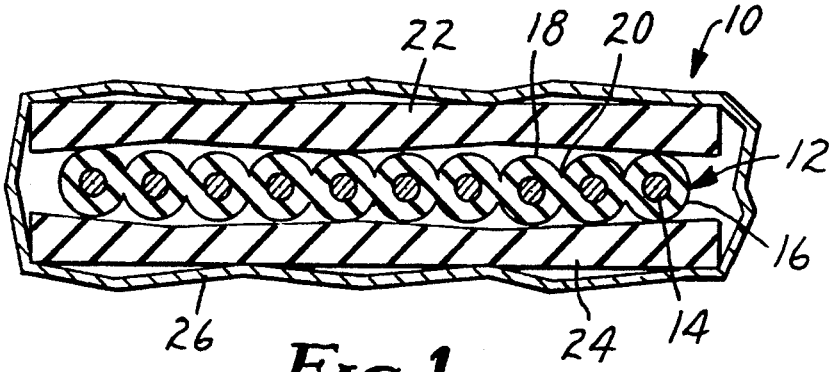
FIG. 1 PRIOR ART
FIG. 1 is a prior cable construction shown in transverse cross-section.

FIG. 1 illustrates an early attempt at producing a high impedance ribbon cable, generally indicated as 10. This cable 10 included a ribbon cable 12 comprised of a series of conductors 14 disposed in parallel, spaced relationship to each other in a single plane. The conductors 14 were surrounded by electrical insulation 16 in the form of a series of cylinders surrounding the conductors 14, with each cylindrical portion of the insulation 16 being joined between adjacent conductors 14 to produce the ribbon cable 12 which was unitary in construction and included any number of conductors 14.

Since the ribbon cable 12 was formed of a number of cylindrical segments, the opposite major surfaces of the cable 12 included raised ridges 18 corresponding in transverse position to the conductors 14 and grooves 20 having a low point which bisects the distance between adjacent conductors 14. These ridges 18 and grooves 20 resulted in profiled major surfaces of the ribbon cable 12 which may be used to accurately locate the position of each conductor 14.

Such a ribbon cable 12 is presently and typically used in conjunction with a connector (not shown) having a number of U-shaped contacts which are designed to cut through the insulation 16 and contact the conductor 14 when the ribbon cable 12 is forced downwardly into the contacts of the connector. In this manner, all conductors 14 of the ribbon cable 12 can be simultaneously and quickly connected to a connector. Such a ribbon cable 12 is thus considered "mass terminable" and can be rapidly and efficiently utilized in, for example, the electronics industry to connect devices which produce or receive a large number of signals. Unfortunately, the insulation 16 of the typical ribbon cable 12 is necessarily thin to produce the locating ridges 18 and grooves 20 and so does not have a high impedance which is necessary for high quality transmission of electrical signals.

FIG. 1 illustrates an early attempt to increase the impedance of a ribbon cable 12 by providing two plates of dielectric 22 and 24, which may be the same or different material as the insulation 16, on either side of the ribbon cable. These plates 22 and 24 were maintained adjacent the ribbon cable 12 by a metal shield 26 which surrounded the assembly and, in most cases, a further layer of insulation (not shown) serving as a protective jacket. This construction was effective to increase the impedance of the cable 10 but there still were problems. The loose connection between the dielectric plates 22 and 24 and the ribbon cable 12, as well as between the shield 26 and the dielectric plates 22 and 24, caused variations in the distance between the conductors 14 and the shield, resulting in impedance and capacitance variation which caused degradation of the transmitted signals. Attempts have been made in the past to improve upon the high impedance cable construction shown in FIG. 1.

Figure 2:
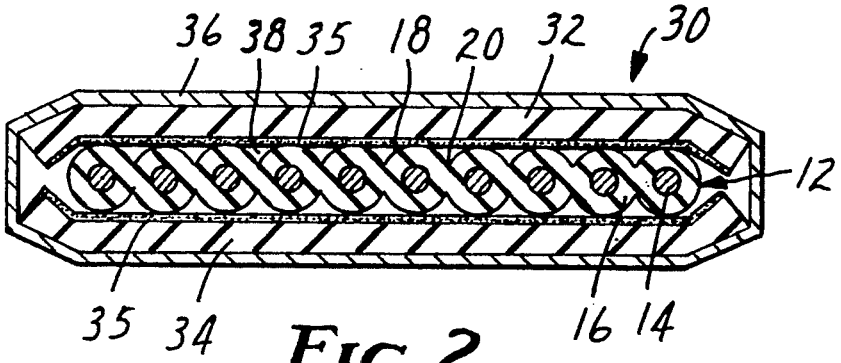
FIG. 2 PRIOR ART
FIG. 2 is a prior cable construction shown in transverse cross-section.

One example is illustrated in FIG. 2, wherein a high impedance cable, generally indicated as 30, included dielectric plates 32 and 34 which were formed at their ends to capture the ribbon cable 12 and which were bonded with an adhesive 35 to the major surfaces of the ribbon cable 12. These dielectric plates 32 and 34 were also surrounded by a shield 36, which was able to conform better to the exterior of the cable 30 and also may have been bonded by an adhesive (not shown) to the dielectric plates 32 and 34. The cable 30 of FIG. 2 improved upon the quality of the signal transmitted over that transmitted by the cable 10 of FIG. 1 because the distance between the conductors 14 and the shield 36 is fixed, resulting in closely controlled impedance, propagation velocity and capacitance. However, the addition of the adhesive between the dielectric plates 32 and 34 and particularly in the pockets 38, reduced the impedance and propagation velocity and increased capacitance owing to the higher dielectric constant of the adhesive. In addition, the adhesive did not cleanly remove from the inner cable surface when the dielectric plates 32 and 34 were removed.

Figure 3:
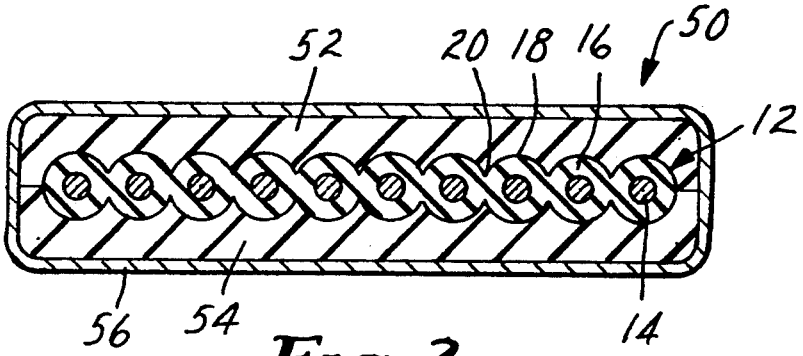
FIG. 3 is a cable of the present invention shown in transverse cross-section.

FIG. 3 illustrates a cable, generally indicated as 50, of the present invention which increases the impedance of a ribbon cable 12 and eliminates the pockets of the prior cable constructions and the variability of conductor-to-shield spacing which resulted in impedance, capacitance and propagation velocity variations. The cable 50 includes two dielectric plates 52 and 54 which are shaped to conform to the ridges 18 and grooves 20 of the ribbon cable 12 and thus eliminate the pockets found in the prior constructions. The dielectric plates 52 and 54 may be formed as separate pieces and adhesively bonded to the ribbon cable 12 or retained in contact with the cable 12 by a shield 56, as shown, or, preferably, may be extruded and laminated while molten to opposite sides of cable 12 either individually or simultaneously, in which case the lines separating the two dielectric plates 52 and 54 and the ribbon cable 12 would not be visible. If extrusion were utilized, the temperature and pressure of extrusion and lamination would cause the plates 52 and 54 to bond to the ribbon cable 12.

In constructing the cable 50 of FIG. 3, a number of conductors 14 are disposed in parallel, spaced relationship in a single plane and are covered by a first layer of dielectric or insulation 16, preferably by extrusion or simultaneous extrusion and lamination. The result of this extrusion process is a conventional ribbon cable 12 as described above with respect to the prior cables 10 and 30. As a secondary step, the two plates 52 and 54 may be adhesively bonded to the ribbon cable 12, retained in contact with the ribbon cable 12 by the shield 56 or, preferably, the plates 52 and 54 are formed in a extrusion operation which simply results in a second layer of insulation which has an outer perimeter in the shape of the two dielectric plates 52 and 54. As a final step, the metal shield 56 is preferably included and, also preferably, adhesively bonded to the exterior of the second layer of insulation forming the dielectric plates 52 and 54.

If it is desired to form the second layer of insulation 52, 54 as separate pieces, an adhesive could be used to eliminate any air between the ribbon cable 12 and the dielectric 52 and 54, so long as the adhesive does not itself cause degradation of the signals propagated. If a suitable adhesive cannot be found, the fact that the second layer of insulation 52 and 54 is formed to conform with the exterior of the ribbon cable 12 will in itself result in improved performance of the overall cable 50. In the case where the second layer of insulation is not retained by an adhesive, it is apparent that a shield 56 would have to be provided to retain the insulation 52 and 54 in contact with the ribbon cable 12.

Materials used for the first and second layers of insulation 12, 52 and 54 may be such conventionally used materials as polyethylene, polypropylene, polyurethane, polyamide, tetrafluoroethylene, thermoplastic elastomers, fluorinated ethylene propylene, EPDM rubber, urethane foam, vinyl or polyvinylchloride. These materials are merely exemplary and any material useful now or hereafter for electrical cable insulation could be utilized so long as it could be effectively adhesively bonded or extruded as described herein. The material comprising the insulation 16 of the ribbon cable 12 is preferably identical to the material forming the second layer of insulation 52 and 54, although these layers may be different insulating materials. The preferred material for both layers of insulation 12, 52 and 54 is available under the trade name Telcar 3050 from Teknor Apex Corporation of Pawtucket, R.I. which is a thermoplastic plastic elastomer.

The preferred material described above is preferably extruded in two layers to form the cable 50, with the first layer being extruded around a series of conductors 14 in the profiled shape of a conventional ribbon cable 12 and the second layer 52 and 54 later extruded over the ribbon cable 12 in a two-step process. It has been found that a bond between the first and second layers of insulation 12, 52 and 54 can be formed by heating the exterior of the ribbon cable 12, for example with infrared heaters, extruding the second layer of insulation 52 and 54 at a temperature of between approximately 350° F. and 380° F. and forcing the second layer of insulation 52 and 54 against the exterior of the ribbon cable 12 under pressure to cause the second layer of insulation to flow into the profile of the ribbon cable 12. It is further preferred that the second layer of insulation 52 and 54 be applied in a two-step process in a fixed-gap laminator, with the second layer of insulation 52 and 54 being applied first to one side of the cable 12 and then the other.

Many variations in extrusion parameters are possible and will be required depending upon the material used. It is important, however, that the bond between the first layer and the second layer of insulation be sufficient to resist separation due to mechanical flexing but weak enough to allow ready separation of the layers for termination of the ribbon cable 12. The construction described thus far results in a first important aspect of the invention wherein impedance is increased by increasing the thickness of the insulation surrounding the conductors without the use of adhesives and with superior impedance control.

A second important aspect of the invention, and the reason insulation is applied to the conductors 14 in a two-step process, is the ability to strip the second layer of insulation 52 and 54 from the first layer of insulation 12 to permit efficient mass termination of the cable 50. As described above, methods and devices exist which allow the efficient and rapid termination of a cable having the configuration of the ribbon cable 12 of FIGS. 1–3. However, such methods do not exist with respect to a cable 50 which includes a significantly increased thickness of insulation. This is because it is difficult to precisely locate the position of conductors 14 within a large body of insulation and it is difficult to drive insulation-cutting contacts through a large volume of insulation. Thus cable 50 of the present invention is designed so that the second layer of insulation 52 and 54 may be readily stripped to expose the first layer of insulation 16 defining the exterior of the ribbon cable 12. Once the ribbon cable 12 is exposed, conventional methods may be used for its termination.

It has been found that adhesive bonding of separately formed second layers of insulation 52 and 54 to the ribbon cable 12 allows for later separation of the first and second layers of insulation 12, 52 and 54, so long as the adhesive is chosen with care to achieve the two ends of the invention. These two ends being the effective control of impedance, capacitance and velocity propagation and the ability to remove the second layer of insulation 52 and 54 when desired. Although possible, the use of an adhesive is not preferred, since there exists the possibility of adhesive residue on the exterior of the ribbon cable 12 and interference with the termination process.

The preferred method of forming the second layer of insulation 52 and 54 is extrusion, and when extrusion of the above-described preferred material is done at the described parameters, a second layer of insulation 52 and 54 is formed which bonds sufficiently and is easily stripped, thus achieved the goals of the invention.

A cable 50 constructed as described with respect to FIG. 3 has the additional benefit of closely matching the electrical properties predicted by widely used mathematical formulae.

The present invention has been described with reference to only a limited number of embodiments, but it will be recognized that many variations will be apparent to those skilled in the art. For example, the exterior shape of the ribbon cable 12 and the exterior shape of the ultimate cable 50 are those presently preferred by the industry but any useful exterior shapes are possible. Also, when the lamination of separate pieces to form the second layer of insulation 52 and 54 over the ribbon cable 12 is desired, any number of pieces in excess of the two shown could be used. It is also possible for the second layer of insulation 52 and 54 to be formed as a single hollow piece which is split to permit insertion of the ribbon cable 12.

We claim:

1. A high impedance, strippable electrical cable comprising:

a series of spaced, parallel conductors lying substantially in a single plane;

a first layer of insulation separating and insulating each of said conductors from each other and having two major surfaces disposed generally parallel to said plane of said conductors, at least one of said major surfaces having at least a portion which is ribbed in that said major surface includes grooves aligned with said conductors and disposed between any two adjacent conductors for locating each conductor with respect to said first layer of insulation;

a second layer of insulation overlying and surrounding said first layer of insulation and bonded to said first layer of insulation sufficiently strongly to resist separation of said first and said second layers of insulation due to mechanical flexing of said cable, but sufficiently weakly to permit said first and said second layers of insulation to be separated manually without significant damage to said first layer of insulation;

said second layer of insulation conforming with said major surfaces of said first layer of insulation sufficiently to substantially fill said grooves of said first layer of insulation.

2. A cable according to claim 1 wherein said second layer of insulation is bonded to said first layer of insulation by an adhesive.

3. A cable according to claim 2 further including a metal shield surrounding said second layer of insulation.

4. A cable according to claim 1 wherein said second layer of insulation is extruded over said first layer of insulation.

5. A cable according to claim 6 further including a metal shield surrounding said second layer of insulation.

6. A cable according to claim 1 wherein said first layer of insulation and said second layer of insulation are of the same material.

7. A high impedance, strippable electrical cable comprising:

at least one conductor;

a first layer of insulation surrounding said conductor;

a second layer of insulation of the same material as said first layer of insulation overlying said first layer and retained in contact with said first layer;

said contact between said first layer of insulation and said second layer of insulation being sufficient to substantially exclude air from between said first layer of insulation and said second layer of insulation but permitting said second layer of insulation to be stripped from said first layer of insulation without materially damaging said first layer of insulation.

8. A cable according to claim 7 wherein said second layer of insulation is extruded over said first layer of insulation.

9. A cable according to claim 8 further including a metal shield surrounding said second layer of insulation.

* * * * *

UNITED STATES PATENT AND TRADEMARK OFFICE

CERTIFICATE OF CORRECTION

PATENT NO. : 5,360,944

DATED : November 1, 1994

INVENTOR(S) : Denis D. Springer, Randall L. Alberg, and Mark W. Breault

It is certified that error appears in the above-identified patent and that said Letters Patent is hereby corrected as shown below:

Column 6, Line 43, "claim 6" should read -- claim 4--.

Signed and Sealed this

Fourteenth Day of February, 1995

*Attest:*

Bruce Lehman

BRUCE LEHMAN

*Attesting Officer*

*Commissioner of Patents and Trademarks*